United States Patent [19]

Liebel

[11] Patent Number: 4,513,864

[45] Date of Patent: Apr. 30, 1985

[54] INTERIOR CORE PROTECTOR

[75] Inventor: Henry L. Liebel, Cincinnati, Ohio

[73] Assignee: Signode Paper Products Company, Cincinnati, Ohio

[21] Appl. No.: 598,220

[22] Filed: Apr. 9, 1984

Related U.S. Application Data

[63] Continuation-in-part of Ser. No. 458,996, Jan. 18, 1983, abandoned.

[51] Int. Cl.[3] ..... B65D 85/66

[52] U.S. Cl. ..... 206/396; 206/415; 206/416; 206/303; 206/586

[58] Field of Search ..... 206/396, 413, 414, 397, 206/415, 416, 303, 586

[56] References Cited

U.S. PATENT DOCUMENTS

| | | | |
|---|---|---|---|
| Re. 30,168 | 12/1979 | Mason . | |
| 542,728 | 7/1895 | Duval . | |
| 1,772,850 | 8/1930 | Wheldon | 206/414 |
| 1,989,182 | 1/1935 | Blake . | |
| 1,989,183 | 1/1935 | Blake . | |
| 2,155,312 | 4/1939 | Houtzaager . | |
| 2,435,093 | 1/1948 | Mitschrich | 206/413 |
| 3,332,601 | 7/1967 | Frank, Jr. | 206/396 |
| 3,875,617 | 4/1975 | Cline . | |
| 3,878,940 | 4/1975 | Wittebort . | |

FOREIGN PATENT DOCUMENTS

| | | | |
|---|---|---|---|
| 243453 | 11/1925 | United Kingdom | 206/414 |

*Primary Examiner*—Joseph Man-Fu Moy
*Attorney, Agent, or Firm*—Wood, Herron & Evans

[57] ABSTRACT

An interior core protector for protecting the interior of a coil of material, e.g., coiled sheet steel, from damage is disclosed. The core protector includes a pair of overlapping formed angular paperboard members each having a series of spaced die cuts in one leg thereof permitting the angular members to be bent to conform to the inner diameter of the coil. The cuts in one leg are offset from the cuts in the other leg such that when the protector is bent for placement in the interior core of the coil and the width of the cuts increases, a paperboard segment of one member nevertheless overlies the cut in the other to provide protection for the material about the full circumference of the interior core. The core protector is characterized in part by economies of materials used, economic use of such materials, and economies of shipment.

9 Claims, 5 Drawing Figures

INTERIOR CORE PROTECTOR

CROSS-REFERENCE TO RELATED APPLICATIONS

This application is a continuation-in-part of U.S. Ser. No. 458,996, filed Jan. 18, 1983, now abandoned.

BACKGROUND OF THE INVENTION

This invention relates to an interior core protector and, more particularly, to the protection of the interior material in a roll of coiled material, for example, a coil of sheet steel.

It is well known that sheet steel, e.g., that which is used extensively in the automobile industry, is placed in large coils by the steel producer for shipment to the user. These coils weigh upwards to 15 tons and include a center core or opening therethrough. It is quite common in strapping of the coil to prevent its uncoiling to place steel straps through the center core and about the outside of the coil. Typically, at least two and sometimes three or four of these straps spaced about the coil are used. Furthermore, it is quite common in the transport of these heavy coils, particularly in their loading and unloading from trucks and railway cars, to use a C-hook which comes down and passes through the center core and is then raised to engage the interior surface of the material to lift the coil on and off the truck or railway car. In doing so, the C-hook often damages the metal particularly by bending of the edges of the material located at the center of the coil. That is, when the C-hook is placed through the coil and raised upwardly into engagement with the material, it is rare that the hook ever engages the material at both edges with equal pressure. Rather, the hook typically first engages one edge and then the other. When this happens, the pressure of the hook on the material causes its bending. This bent material, of course, is not usable and must be scrapped. It is not uncommon for the user to have to scrap 30 to 50 feet of the sheet metal because of such damage.

In addition to damage by the C-hook in loading and unloading of the coil material, it is also quite common for the transporter to throw a chain through the interior core of the coil to secure the coil on a truck or railway car. This likewise causes damage to the edges of the material causing waste and scrap of what would otherwise be usable material.

It has been suggested therefore to provide some form of protection for the material about the interior core of the coil. However, prior attempts to provide such protection have not been wholly successful either economically or in terms of providing the protection needed.

SUMMARY OF THE INVENTION

It is among the principal objects of this invention to provide an interior core protector for positioning about the inner diameter of a roll of coiled material to protect the material from damage that is relatively economic to produce, that provides full protection for the material about the 360° circumference of the interior core, and that provides advantages in terms of economic use of materials and economies of shipping to the customer.

In the presently preferred form of the invention, the interior core protector includes a pair of overlapping formed angular paperboard members which are manufactured in a flat, i.e., non-arcuate configuration. One leg of each of the members includes a series of cuts spaced along its length and extending from the free edge of the leg to the angle joining the legs. These cuts permit bending of the core protector to conform to the inner diameter of the coil. The cuts in the legs of one of the members are offset with respect to the cuts in the other member such that when the protector is bent to conform to the inner diameter of the coil and the spacing along each cut correspondingly increases, i.e., the cut opens up when the protector is bent, there is nevertheless provided a section of paperboard material overlapping each cut. The core protector thus provides protection for the material about the complete circumference of the inner core of the coil. Thus, when a chain is thrown through the core or a C-hook passing through the coil engages the material, the edges of the inner length of the material are protected from damage. No special locating or positioning of the C-hook, for example, is needed. Rather, since 360° protection to the edges of the material at the inner core is provided, the coil may be grasped at any location.

Among the many advantages of the present invention are the protection it provides the coiled material including protection to the edges of the inner length of material around the entire circumference of the inner core, the economy of the materials of construction in that the protector is preferably formed of relatively inexpensive paperboard, the economic use of this material in that there is very little waste in forming the protector, the rigidity of the formed angular members whereby when the protector is placed in the core the flanges closely conform to the material and do not fall down or tend to flatten out, the fact that the angular members once bent tend to want to straighten out and thus when placed in the core the protector tends to urge itself into engagement with the inner diameter of the coil, and the fact that the protector can be economically packaged and shipped merely by stacking up a series of protectors one on another and shipping them in a straight or non-arcuate position. This results in full utilization of shipping capacity with no waste of space.

These and other objects of the present invention will be apparent from the following detailed description, reference being had to the accompanying drawings.

DETAILED DESCRIPTION OF THE INVENTION

Figure 1:
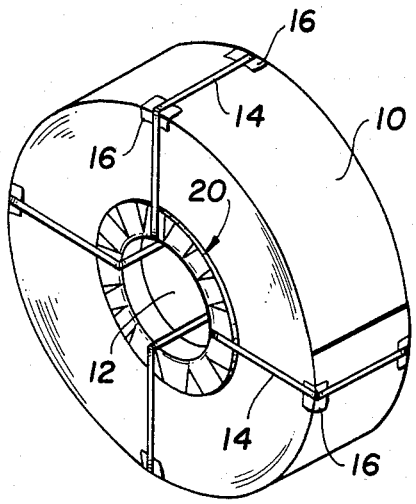
FIG. 1 is a perspective view showing the interior core protector of the present invention positioned within a coil of sheet steel.

Referring to FIG. 1, there is shown a coil of sheet material 10, for example, a large and heavy coil of sheet steel of the type typically used in the automobile industry, for purposes of illustrating the environment in which the present invention finds particular applicability. As shown in FIG. 1, the sheet material is coiled to form a large roll of material having a open center core 12. A series of steel bands 14 are placed through the core 12 and about the coiled material to keep the material from uncoiling. As is common practice in the industry, paperboard angles 16 are provided on the outer diameter of the coil 10 to keep the edges of the sheet steel from cutting the steel straps. The interior core protector 20 of the present invention is adapted to be placed about the inner core 12 of the coil 10 on both sides of the coil, i.e., two protectors are used for each coil. Thus, when the coil protectors 20 are positioned in the core 12 of the coil 10 as shown in FIG. 1, the protectors 20 form a protective barrier around the inner edges of the coiled material.

Figure 2:
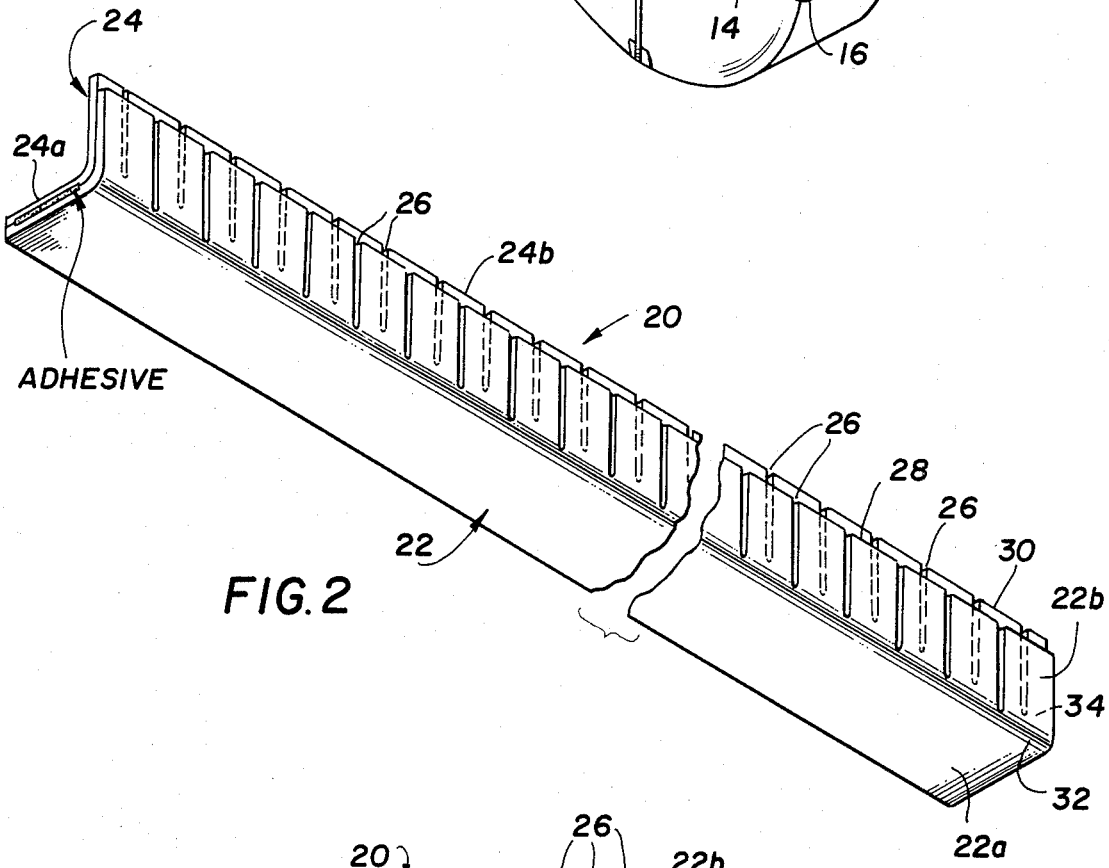
FIG. 2 is a perspective view of the interior core protector as manufactured and before bending.

Referring in addition to FIG. 2, the core protector 20 is formed of two like overlapping formed angular paperboard members 22 and 24. Each member 22 and 24 includes a pair of legs 22*a* and 22*b* and 24*a* and 24*b*, respectively, which are generally at right angles one to another. The protector 20 is preferably formed of a relatively inexpensive material such as paperboard. A presently preferred thickness of the protector is on the order of 0.120 inch, this being the total thickness of the protector or sum of the thicknesses of the two members 22 and 24. One leg 22*b* and 24*b* of each member is die cut to provide a series of generally equally spaced cuts 26 extending from the outer edge 28 and 30, respectively, of each leg 22*b* and 24*b* to the angle 32 and 34, respectively, at which the two legs 22*a* and 22*b* and 24*a* and 24*b* of each member meet. These die cuts 26 permit the protector to be bent in the generally circular configuration shown in FIG. 1. The two members may be joined by an adhesive placed between the overlapping uncut legs 22*a* and 24*a* of the angles 22 and 24.

In a presently preferred form of the invention, the protector 20 is about 75 inches long to cover the circumference of a 24-inch diameter core and each leg is approximately 3 inches long. Thus, when the protector is bent to conform to the diameter of the core and is placed in use as shown in FIG. 1, an area of protective paperboard extends interiorly 3 inches from the outer edge the coil from both sides of the coil and 3 inches radially outwardly along the face of each side of the coil 10.

Figure 3:
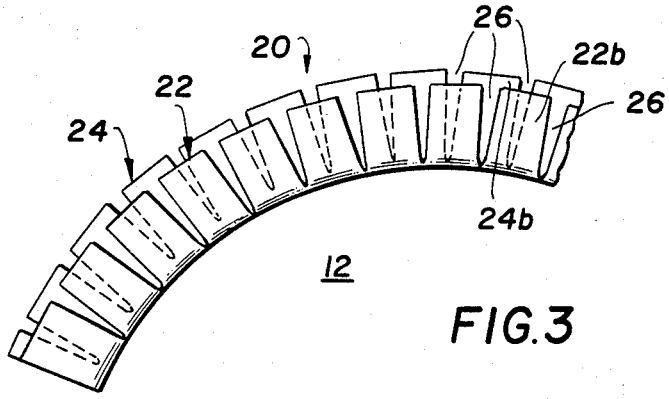
FIG. 3 is a sectional view showing an arc of the core protector when positioned in use.

As shown in FIG. 2, the cuts 26 in one leg 22*b* of one member 22 are offset from the cuts 26 in the leg 24*b* of the other member 24. Thus, when the protector 20 is bent into its generally circular configuration and the width of the cuts 26 correspondingly widens, as shown in FIG. 3, there nevertheless is maintained at each cut 26 a section of protective material which overlies the openings caused by the cuts. As shown in FIG. 3, a section 22*b* overlies the cut 26 in leg 24, and a section 24*b* overlies the cut 26 in leg 22. Thus, even though the cuts 26 open up on bending of the material, because of the overlapping legs 22*b* and 24*b* there is maintained protective paperboard material about the entire circumference of the coil. It is important to note that legs 22*b* and 24*b* are not glued together prior to bending of the core protector since the sections between the cuts 26 must be free to slide over their overlying sections to permit bending of the protector. However, in some cases, particularly with lighter material, it may be desired to adhere the overlying sections together after bending so that the sections do not fall or extend outwardly where possibly they may be torn off during use. Both objectives may be accomplished by providing the surface of leg 22*b* facing leg 24*b* with a layer of pressure sensitive adhesive covered with a removable release paper. The release paper prevents the facing legs from adhering before bending. To form the core protector to the shape of the interior core of the coil, it is merely necessary to remove the release paper thereby exposing the pressure sensitive adhesive, bend the protector to its generally circular configuration, insert the protector in the coil, and then press the legs 22*b* and 24*b* together.

Figure 4:
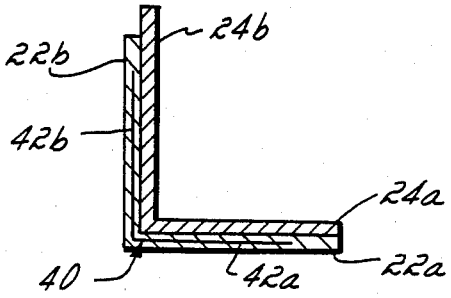
FIG. 4 is a cross-sectional view of an alternative embodiment of the core protector shown in FIGS. 1–3.
Figure 5:
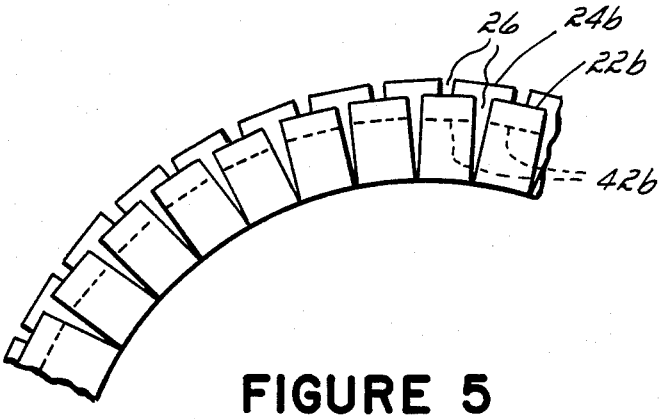
FIG. 5 is a view similar to FIG. 3 showing an arcuate portion of the core protector of FIG. 4.

There exist other alternatives for increasing the rigidity of the core protector and particularly the legs 22*b* to maintain them upright and in close relation to legs 24*b*. As shown in FIG. 4, a bendable but relatively rigid piece of material such as a piece of sheet steel 40 of 0.020 inches thickness, for example, may be laminated between the paperboard layers of member 22 so that when angular member 22 is formed it includes therein the angular member 40 having legs 42*a* and 42*b* extending respectively along legs 22*a* and 22*b* of member 22. Preferably, legs 42*a* and 42*b* terminate short of the ends of legs 22*a* and 22*b* so as not to expose any potentially sharp metal edges. The sheet steel 40 is likewise die-cut at 26 to permit spreading between the legs 22*b* when the core protector is bent to its arcuate shape in use (FIG. 5). The steel sheet 40 being relatively stiff readily serves to hold the die-cut legs 22*b* upright and close to legs 24*b*.

With the protectors 20 in place in the core 12, when the coil is grasped, for example, by a C-hook, or a hold down chain is thrown through the core, protection of the edges of the inner length of the coiled material is provided about the full circumference of the inner core. Thus, the core protector 20 provides for complete protection along the entire 360° circumference of the core, and the C-hook can therefore enter the core from any position about the core.

One of the advantages of the present invention is that when the protector 20 is bent to conform to the diameter of the core 12 the resiliency or memory properties of the paperboard material from which the protector is made tends to want to straighten the material back to its flat or unbent condition. This is desirable since it causes the protector to expand outwardly and, as a result, to tightly engage the material about the inner core. Thus, there is no need for any special provision for either locating or holding the core protector in position before strapping of the coil. Second, since the core protector is made of a formed angular paperboard member, the angle between the legs is rigid and maintains itself in both the unbent and bent conditions of the core protector. Thus, the legs having the cuts 26 tend to lie flat against the surface of the coil as contrasted to falling down as would be case if a flat material such as paper were only creased to lie against the face of the coil. Third, in addition to being made of relatively inexpensive paperboard material, the core protector makes very economic use of this material. That is, there is no waste of material as would otherwise occur if the core protector were to be made as a annular piece. This would require cutting of an annulus out of a flat square sheet which would waste the core as well as the material lying outside the outer diameter of the annulus. Thus, a savings in material on the order 60% is realized with the core protector of the present invention.

Still further, in the preferred form of the invention, the core protector can be packaged and shipped in its flat or unbent condition (as shown in FIG. 2) such that the core protector must be bent by the user to fit it into the coil. This permits the protectors to be economically packaged and shipped merely by stacking them one on another. There is none of the wasted space which would be occasioned if annular protectors were shipped.

Thus, the core protector of the present invention provides not only excellent protection for the coiled material but is relatively economic to produce and to ship. Since these core protectors are a disposable item, this is very important to the producers of the coiled material.

Although the presently preferred form of this invention utilizes paperboard as the material of construction for the reasons stated above, it will be appreciated that other materials such as sheet steel or other metal may be used instead if so desired.

Thus having described the invention, I claim:

1. An interior core protector for positioning about the inner circumference of a coil of material having a core to protect the material from damage, comprising:

a pair of rigid, preformed angles overlapping one another, and having first and second ends, each said angle having a first leg and a second leg, said second leg having a plurality of spaced cuts therein extending from the angle to the outer edge thereof, said first leg of each said angle being bendable whereby said first and second ends may be brought together to form an annulus, the length of said angles being such that the circumference of said annulus is substantially at least as great as the circumference of the core, said cuts in said second leg of each said angle widening on bending of said first legs permitting bending of said angles to conform to the circumference of the core, said cuts in the second leg of one of said angles being offset with respect to the cuts in the second leg of the other of said angles so that when said interior core protector is operatively positioned in a coil of material each cut in either leg is covered by a portion of the other leg to provide protection for the coil of material around substantially the entire circumference of the core, said angles having sufficient rigidity such that when said core protector is operatively positioned in a coil of material one of said second legs lies against the flat face of the coil and the other of said second legs lies against the said one of said second legs.

2. The interior core protector of claim 1 wherein said angles are formed of paperboard.

3. The interior core protector of claim 1 wherein said first legs of said angles are joined together by means of an adhesive.

4. The interior core protector of claim 1 wherein the thickness of the protector is about 0.120 inch.

5. The interior core protector of claim 1 wherein each leg is about 3 inches long.

6. The interior core protector of claim 1 further comprising a layer of adhesive between said second legs operative to join said second legs after bending of said protector.

7. The interior core protector of claim 1 further characterized in that it is storable and shippable in an unbent condition and bendable to conform to the circumference of the core of the coil with which it is to be used.

8. The core protector of claim 2 further comprising a bendable but relatively more rigid material laminated to the one of the paperboard angle members forming the outer member of the core protector when it is in use, said material having a plurality of cuts coincident with the cuts in the one said angle member permitting bending of it with bending of the one said angle member.

9. An interior core protector for positioning about the inner circumference of a coil of material having a core to protect the material from damage, comprising:

a pair of rigid, preformed angles overlapping one another, and having first and second ends, each said angle having a first leg and a second leg, said second leg having a plurality of spaced cuts therein extending from the angle to the outer edge thereof, said first leg of each said angle being bendable whereby said first and second ends may be brought together to form an annulus, the length of said angles being such that the circumference of said annulus is substantially at least as great as the circumference of the core, said cuts in said second leg of each said angle widening on bending of said first legs permitting bending of said angles to conform to the circumference of the core, said cuts in the second leg of one of said angles being offset with respect to the cuts in the second leg of the other of said angles so that when said interior core protector is operatively positioned in a coil of material each cut in either leg is covered by a portion of the other leg to provide protection for the coil of material around substantially the entire circumference of the core, said angles having sufficient rigidity such that when said core protector is operatively positioned in a coil of material one of said second legs lies against the flat face of the coil and the other of said second legs lies against the said one of said second legs, said first legs having sufficient resiliency such that when bent to form said annulus said first legs tend to expand outwardly in said core thereby holding said core protector against the circumference of said core.

* * * * *